US005807069A

United States Patent [19]

Girbig

[11] Patent Number: 5,807,069

[45] Date of Patent: Sep. 15, 1998

[54] PROCESS AND DEVICE FOR IMAGING THE OPERATIONAL CONDITION OF A TURBINE DURING THE STARTING PROCESS

[75] Inventor: Paul Girbig, Uttenreuth, Germany

[73] Assignee: Siemens Aktiengesellschaft, Munich, Germany

[21] Appl. No.: 619,088

[22] Filed: Mar. 21, 1996

Related U.S. Application Data

[63] Continuation of PCT/DE94/01039 Sep. 9, 1994.

[30] Foreign Application Priority Data

Sep. 21, 1993 [DE] Germany ..... 43 32 078.3

[51] Int. Cl.[6] ..... F04D 29/00

[52] U.S. Cl. ..... 415/118

[58] Field of Search ..... 415/118

[56] References Cited

U.S. PATENT DOCUMENTS 4,181,840 1/1980 Osborne .

4,644,270 2/1987 Iates et al. ..... 415/118

FOREIGN PATENT DOCUMENTS 0275192 7/1988 European Pat. Off. .

269032 6/1989 Germany .

OTHER PUBLICATIONS

Journal entitled "Elektrotechnik" (Electrical Engineering) vol. 49, No. 20, Sep. 30, 1971, pp. 903–913;.

*Primary Examiner*—John T. Kwon

*Attorney, Agent, or Firm*—Herbert L. Lerner; Laurence A. Greenberg

[57] ABSTRACT

A process and a device for imaging the operational condition of a turbine during a starting process include imaging a reference course being ascertained from turbine-specific characteristics and from operation-relevant parameters. As the reference course, a particular characteristic starting curve derived from the turbine-specific values is determined, which is ascertained by the operation-relevant parameters from a number of stored characteristic starting curves. A course over time of a turbine rpm is imaged in addition to the reference course.

4 Claims, 1 Drawing Sheet

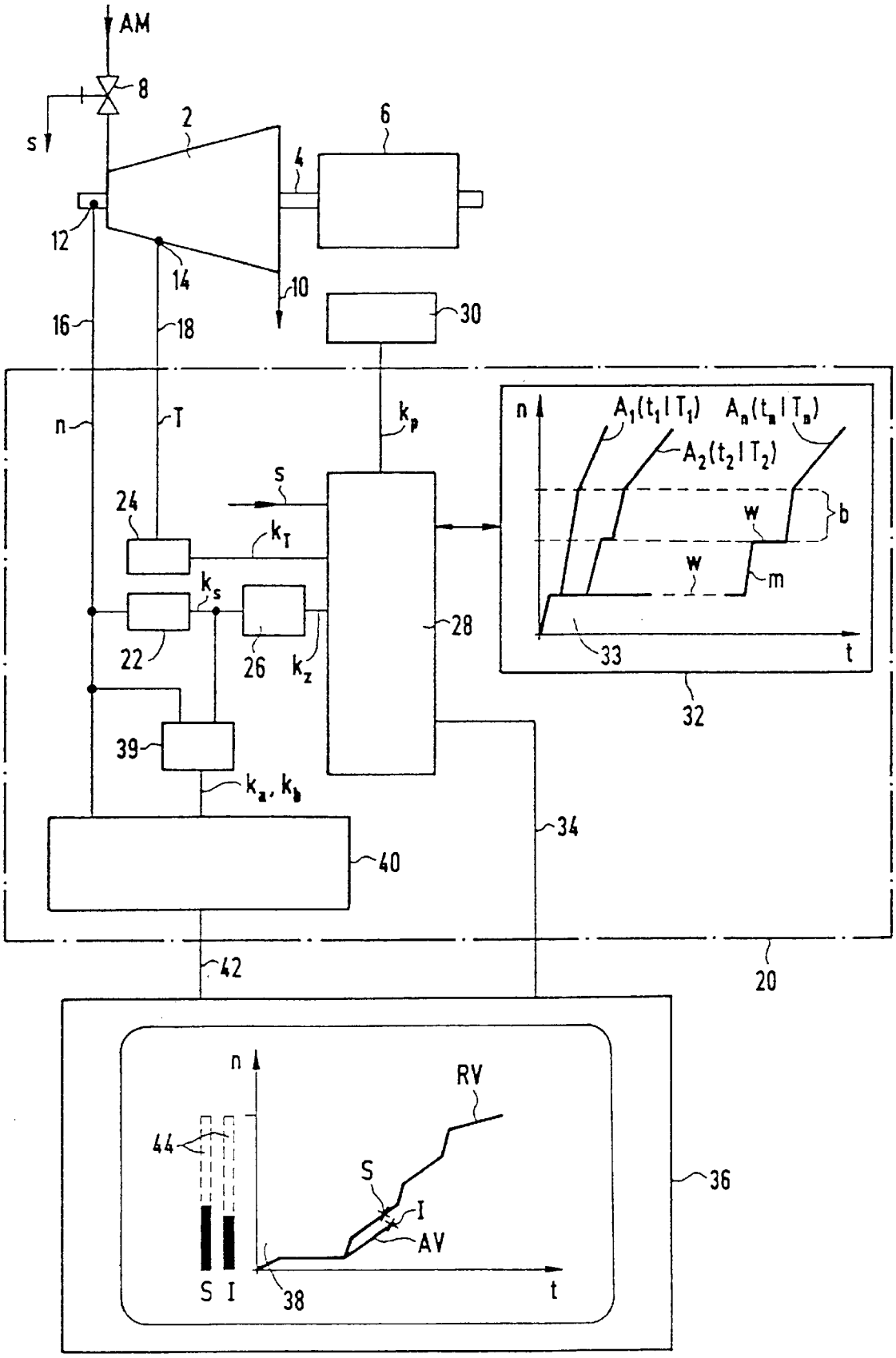
AM
8
s
2
6
4
12
14
10
30
16
18
n
T
$k_p$
s
24
$k_T$
$k_s$
22
26
$k_z$
28
39
$k_a, k_b$
40
34
42
20
n
$A_1(t_1 | T_1)$
$A_n(t_n | T_n)$
$A_2(t_2 | T_2)$
w
b
w
m
33
t
32
n
RV
44
S
I
AV
S I
38
t
36

PROCESS AND DEVICE FOR IMAGING THE OPERATIONAL CONDITION OF A TURBINE DURING THE STARTING PROCESS

CROSS-REFERENCE TO RELATED APPLICATION

This application is a Continuation of International Application Serial No. PCT/DE94/01039, filed Sep. 9, 1994.

BACKGROUND OF THE INVENTION

1. Field of the Invention

The invention relates to a process for imaging the operational condition of a turbine during a starting process, in which a reference course, ascertained from turbine-specific characteristics and from operation-relevant parameters, is imaged, and as the reference course, the particular characteristic starting curve derived from the turbine-specific values is determined, which is ascertained through the use of the operation-relevant parameters from a number of stored characteristic starting curves.

The invention also relates to a device for imaging the operational condition of a turbine during a starting process, having a display device connected to a first arithmetic unit for generating a reference course over time of a turbine rpm, ascertained from turbine-specific characteristics and from operation-relevant parameters, and a memory provided for a number of characteristic starting curves characterizing the turbine-specific characteristics, each of the characteristic starting curves having an identifier for a certain standstill time and a certain turbine temperature.

The process of starting up a turbine, such as a steam turbine, from a standstill to an idling or operating rpm, is typically composed of different rpm rise and waiting times. The course of the rpm rise over time until the operating rpm is reached depends in particular on turbine-specific characteristics and on the thermal status of the turbine.

In an automatic starter for turbogenerators, which is known from the journal entitled "Elektrotechnik" [Electrical Engineering], Vol. 49, No. 20, Sep. 30, 1971, pages 903–913, the starting process is adjusted in such a way that rpm rise and waiting times, for instance being specified by the turbine manufacturer, are chronologically monitored by an operating staff on the basis of a characteristic starting curve selected from a number of reference courses. However, the danger then exists of the specified waiting times, for instance, being made shorter or longer, so that the turbine is either exposed to unnecessary loads or the starting process is unnecessarily prolonged.

2. Summary of the Invention

It is accordingly an object of the invention to provide a process and a device for imaging the operational condition of a turbine during a starting process, which overcome the hereinafore-mentioned disadvantages of the heretofore-known methods and devices of this general type and with which a suitable imaging of the operating state of the turbine during the starting process is made possible and is carried out simply.

With the foregoing and other objects in view there is provided, in accordance with the invention, a process for imaging the operational condition of a turbine during a starting process, which comprises imaging a reference course being ascertained from turbine-specific characteristics and from operation-relevant parameters; determining as the reference course a particular characteristic starting curve derived from the turbine-specific values, being ascertained by the operation-relevant parameters from a number of stored characteristic starting curves; and imaging a course over time of a turbine rpm in addition to the reference course.

The reference course represents the functional dependency of the change over time of the turbine rpm on the turbine-specific characteristics and on the operation-relevant parameters derived from measured values.

Each characteristic starting curve is suitably defined by one value for the standstill time of the turbine and one value for the turbine temperature.

In accordance with another mode of the invention, the turbine temperature and the standstill time of the turbine are detected as the operation-relevant parameters. The standstill time is derived from the turbine rpm, in such a way that the time elapsed since a standstill or an approaching standstill of the turbine is detected.

Process-dictated or system-dictated parameters are specified manually or through the use of logic as a further criterion for determining a characteristic starting curve as a reference course. As a result, exceeding critical values of one of the units driven by the turbine, such as an air compressor, is reliably avoided.

In accordance with a further mode of the invention, in order to enable each starting process of the turbine to be performed at any time, the imaged course over time of the turbine rpm is expediently simultaneously stored in memory. The storage process occurs between a start signal and a stop signal that is output upon attainment of an idling or operating rpm of the turbine.

With the objects of the invention in view, there is also provided a device for imaging the operational condition of a turbine during a starting process, comprising a display device; a first arithmetic unit connected to the display device for generating a reference course over time of a turbine rpm, being ascertained from turbine-specific characteristics and from operation-relevant parameters; a memory connected to the first arithmetic unit for a number of characteristic starting curves characterizing the turbine-specific characteristics, each of the characteristic starting curves having an identifier for a certain standstill time and a certain turbine temperature; and a second arithmetic unit connected to the display device for generating a current course over time of the turbine rpm.

Other features which are considered as characteristic for the invention are set forth in the appended claims.

Although the invention is illustrated and described herein as embodied in a process and a device for imaging the operational condition of a turbine during a starting process, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing is a schematic and block circuit diagram of an exemplary embodiment of a device for imaging the starting process of a turbine according to the invention.

DESCRIPTION OF THE PREFERRED EMBODIMENTS

Referring now in detail to the single FIGURE of the drawing, there is seen a turbine 2 on a shaft 4, for driving a unit 6, such as a generator or an air compressor. To that end, the turbine 2 is supplied through a fast-closure valve of a final control element 8 with operating medium AM, which expands fully or partially in the turbine and thus drives the turbine 2. The operating medium AM flows out of the turbine 2 through an outflow line 10. The turbine 2 is a steam or gas turbine.

In order to detect operation-relevant parameters of the turbine 2, a first sensor 12 for measuring the turbine rpm n and a second sensor 14 for measuring the turbine temperature T are provided. Signal lines 16 and 18 each lead away from a respective one of the sensors 12 and 14, and signals corresponding to the turbine rpm n and the turbine temperature T are supplied over these lines to a configuration 20, shown in dashed lines, for preparation and processing of measured values. The temperature T is suitably measured at the turbine housing.

The configuration 20 includes a converter 22 connected to the signal line 16 and a converter 24 connected to the signal line 18. In the converter 22, a signal $k_s$ that is characteristic for the rotational status of the turbine 2, is formed by a limit value monitoring of the turbine rpm n. This signal indicates whether the turbine 2 is at a standstill or nearly at a standstill. The signal $k_s$ is carried to a time module 26 that follows the converter 22. Upon arrival of the signal $k_s$, the time module 26 is started. This time module forms a time factor $k_z$ from the signal $k_s$. The time factor $k_z$ informs a first arithmetic unit 28 about a period of time that has elapsed since the arrival of the standstill signal $k_s$.

Since a turbine standstill can only be imprecisely determined at a low rpm n, that is only a few revolutions per unit of time, an additional sampling is made in terms of measurement technology to find the position of the fast-closure valve of the final control element 8. The additional sampling is in the form of a feedback signal s. If the final control element 8 is closed, then a corresponding feedback signal s is sent to the arithmetic unit 28. If at the same time the converter 22 detects that a limit value of the turbine rpm n is undershot and a signal $k_s$ is generated, then the beginning of the standstill period at which the turbine rpm n is equal to zero, is fixed through the use of the time factor $k_z$.

In the converter 24, a temperature factor $k_T$ is formed from a measurement of the temperature T of the turbine 2, for instance through the use of a characteristic curve which describes the thermal status of the turbine 2. The temperature factor $k_T$ is carried to the arithmetic unit 28. Thus the range of the temperature factor $k_T$ corresponding to the possible range of the turbine temperature T is between $k_T$=0.1 and $k_T$=1.

In order to take into account other process-dependent parameters or criteria, such as critical values or relevant limit values of the unit 6 driven by the turbine 2, the arithmetic unit 28 is supplied through a control element 30 with an adjustable process factor $k_p$, which is derived from the process criteria.

The arithmetic unit 28 ascertains a reference course RV S for a starting process for the turbine 2, from the factors $k_T$, $k_z$ and $k_p$ and from turbine-specific characteristics stored in a memory 32. To that end, the memory 32 contains a number of characteristic starting curves $A_n$. Each characteristic starting curve $A_n$ is provided with an identifier for a standstill time $t_n$ and a turbine temperature $T_n$. Some typical characteristic starting curves $A_n$ are shown in a diagram 33, with their time-dependent command or reference course. Each characteristic starting curve $A_n$ is assigned turbine-specific characteristics, such as rpm rise gradients m, waiting times w, and a critical rpm range b that must be run through especially fast.

If the factors $k_z$ and $k_T$ ascertained in the arithmetic unit 28 cannot be associated directly with either of two adjacent characteristic starting curves $A_{n-1}$ and $A_n$, then the characteristic starting curve $A_n$ having the longer waiting times w and/or flatter rpm rise gradients m is expediently designated as the reference course RV. The situation in which the unit 6 driven by the turbine 2 requires longer waiting times w or flatter rpm rise gradients m than the turbine 2 itself, is likewise taken into account through the use of the process factor $k_p$. In that case as well, the next-flatter characteristic starting curve $A_n$ is designated, by comparison with a characteristic starting curve $A_{n-1}$ that takes into account only the turbine 2. As a result, unnecessary loads on the turbine 2 and/or on the unit 6 are avoided.

The reference course RV which is determined through the use of the factors $k_T$, $k_z$ and $k_p$ is carried over a signal line 34 to a display device 36 and imaged there in a coordinate field 38. The abscissa forms the time axis indicated by reference symbol t, and the ordinate forms the rpm axis indicated by reference symbol n.

If the turbine 2 is started up from a standstill, then a starting signal $k_a$ is generated in a converter 39 through the use of the signal $k_s$ and the rpm n. This signal is carried to a second arithmetic unit 40. Instead of sampling the signal $k_s$, a signal from a non-illustrated turbine controller can also be used to form the starting signal $k_a$. A starting time t=0 of the course over time of the turbine rpm n during the starting process of the turbine 2 is determined in the arithmetic unit 40 through the use of the starting signal $k_a$.

Beginning at this starting time t=0, the course over time of the turbine rpm n is stored in memory in the arithmetic unit 40 during the starting process of the turbine 2. At the same time, the instantaneous actual value of the rpm n is carried from the arithmetic unit 40 over a signal line 42 to the display device 36. There, a current course over time AV up to an instantaneous actual value I is imaged. In order to provide a rapid overview for an operating staff, the instantaneous actual value I and a command or set-point value S of the reference course RV, being present at the same time t, are shown in a bar diagram 44. If the attainment of an idling or operating rpm of the turbine 2 is noted through the use of limit value sampling of the rpm n in the converter 39, then the converter 39 sends a stop signal $k_b$ to the arithmetic unit 40 and the memory storage process is then terminated.

The contents in memory of the arithmetic units 28 and 40 can be called up in curve form RV, AV through the use of the display device 36. Thus at any time an arbitrary starting process of the turbine 2 can be called up by imaging the reference course RV and the current course over time AV, so that both during a current starting process and in a later check, a direct comparison can be made between the actual rpm course AV and the reference course RV during the starting process of the turbine 2.

I claim:

1. A process for displaying the operational condition of a turbine during a starting process, which comprises:

providing at least two sensors for measuring operation-relevant parameters of a turbine, providing a first arithmetic unit and a second arithmetic unit, providing a memory connected to the first arithmetic unit for storing a characteristic starting curve having turbine-specific characteristics corresponding to the operation-relevant parameters of the turbine, and providing a display device;

ascertaining operation-relevant parameters of the turbine from the at least two sensors and providing the operation-relevant parameters to the first arithmetic unit;

using the first arithmetic unit for determining a reference course by selecting from the memory the characteristic starting curve having turbine-specific characteristics corresponding to the operation-relevant parameters of the turbine;

using the second arithmetic unit for determining a course over time of an actual turbine rpm; and providing display information from the first arithmetic unit and the second arithmetic unit to the display device for displaying the course over time of the actual turbine rpm in addition to the reference course on the display device.

2. The process according to claim 1, which comprises ascertaining a turbine temperature and a standstill time of a turbine as the operation-relevant parameters, and deriving the standstill time from the turbine rpm.

3. The process according to claim 1, which comprises simultaneously storing in the memory a displayed course over time of the turbine rpm, by beginning the storing in the memory at a starting signal and ending the storing in the memory at a stop signal being output upon attainment of an operating rpm of the turbine.

4. A device for displaying the operational condition of a turbine during a starting process, comprising:

a display device;

at least two sensors for determining operation-relevant parameters of a turbine, said operation-relevant parameters including a certain turbine rpm and a certain turbine temperature;

a memory for storing a number of characteristic starting curves characterizing the turbine-specific characteristics, each of the characteristic starting curves having an identifier for a certain standstill time derived from said certain turbine rpm and said certain turbine temperature;

a first arithmetic unit connected to said memory for generating a reference course over time of a turbine rpm, said first arithmetic unit receiving said operation-relevant parameters from said at least two sensors and selecting said characteristic starting curve characterizing the turbine-specific characteristics corresponding to said operation-relevant parameters, said reference course over time defined by said selected characteristic starting curve;

a second arithmetic unit connected to said display device and at least one of said at least two sensors for generating a current course over time of the turbine rpm, said display device displaying said current course over time of the turbine rpm; and said display device also connected to said first arithmetic unit for displaying said reference course over time of a turbine rpm concurrently with said current course over time of the turbine rpm.

* * * * *